US005326317A

United States Patent [19]

Ishizu et al.

[11] Patent Number: 5,326,317

[45] Date of Patent: Jul. 5, 1994

[54] VENTILATOR

[75] Inventors: Tetsuo Ishizu; Masao Wakai, both of Komaki, Japan

[73] Assignee: Matsushita Seiko Co., Ltd., Osaka, Japan

[21] Appl. No.: 960,061

[22] Filed: Oct. 14, 1992

[30] Foreign Application Priority Data

Oct. 18, 1991 [JP] Japan ..... 3-270756

[51] Int. Cl.[5] ..... F24F 7/007; F24F 13/24

[52] U.S. Cl. ..... 454/354; 181/202; 181/224; 454/906

[58] Field of Search ..... 181/202, 205, 206, 224, 181/225; 454/341, 346, 354, 906

[56] References Cited

U.S. PATENT DOCUMENTS

| | | | |
|---|---|---|---|
| 2,061,535 | 11/1936 | Davies | 454/906 X |
| 3,085,647 | 4/1963 | Jenn et al. | 454/346 X |
| 4,091,892 | 5/1978 | Hehmann et al. | 181/224 X |
| 4,327,816 | 5/1982 | Bennett | 181/224 X |
| 4,346,781 | 8/1982 | Ingard et al. | 181/206 |

FOREIGN PATENT DOCUMENTS

| | | | |
|---|---|---|---|
| 2804027 | 8/1979 | Fed. Rep. of Germany | 454/354 |
| 55-61253 | 1/1980 | Japan . | |
| 60-27855 | 8/1985 | Japan . | |

*Primary Examiner*—Marold Joyce

*Attorney, Agent, or Firm*—Stevens, Davis, Miller & Mosher

[57] ABSTRACT

A ventilator has incorporated in a main body thereof an air blower having a ventilation casing provided with a fan intake opening facing an intake opening of the main body of the ventilator, the inner side of the main body being opened to form the intake opening thereof. A cylindrical soundproof unit including an inner ventilation passage having a larger ventilation area than a fan intake space and formed of a laminated plate which is formed of a plurality of air layers arranged in a direction intersecting the rotation axis of the air blower from the inner ventilation passage, is disposed in a space between the fan intake opening and the intake opening of the main body. The soundproof unit makes it possible to decrease noise generated by the air blower while the ventilation resistance is hardly increased.

6 Claims, 3 Drawing Sheets

VENTILATOR

BACKGROUND OF THE INVENTION

1. Field of the Invention

The present invention relates to a ventilator which has a soundproof construction which reduces the amount of noise propagated into a room, which noise is generated by an air blower or the like.

2. Description of the Related Art

In recent years, there has been much demand for a ventilator having an air blower incorporated therein because it creates a pleasant indoor environment. Therefore, it has been desired that noise generated by the air blower in the ventilator be as low as possible. Under these circumstances, a ventilator has been hitherto constructed as disclosed in, for example, Japanese Utility Model Laid-Open. No. 55-61253.

The construction of the conventional ventilator will be explained below with reference to FIG. 5.

As shown in FIG. 5, the main body 101 of the ventilator incorporates therein an air blower 104 having a ventilation casing 103 provided with a fan intake opening 102, an intake opening 105 being provided on the bottom side of the main body, which side the fan intake opening 102 faces. Plate-like sound absorbing members 107 having a great number of ventilation holes 106 are provided in the entire surface of the intake opening 105 of the main body.

With the construction described above, noise generated by the air blower 104 is absorbed by the sound absorbing members 107, and the propagation of the noise into a room is reduced.

In such a conventional ventilator, as the plate-like sound absorbing members 107 having the great number of ventilation holes 106 are provided over the entire surface of the intake opening 105 of the main body, the sizes of the sound absorbing members 107 must be made quite large to increase the sound absorbing effect. As a result, the respective sizes of the openings of the ventilation holes 106 must be decreased, thus causing problems, namely, ventilation resistance being increased and ventilation efficiency being decreased.

SUMMARY OF THE INVENTION

The present invention solves the above-mentioned problems of the prior art.

An object of the present invention is to provide a ventilator in which, even if noise generated by an air blower is decreased, ventilation resistance is hardly increased and ventilation efficiency is not decreased.

A further object of the present invention is to increase a soundproof effect in the ventilator so that the above decrease in noise generated by the air blower is made greater.

To these ends, according to an aspect of the present invention, there is provided a ventilator which has incorporated in the main body thereof an air blower having a ventilation casing provided with a fan intake opening facing an intake opening of the main body of the ventilator, the inner side of the main body being opened to form the intake opening thereof, wherein a cylindrical soundproof unit including a ventilation passage having a larger ventilation area than a fan intake space and formed of a laminated plate which is formed of a plurality of air layers arranged in a direction intersecting the rotation axis of the air blower from the inner ventilation passage, is disposed in a space between the fan intake opening and the intake opening of the main body.

According to another aspect of the present invention, in the ventilator, the soundproof unit is disposed in such a way that a space is formed between the outer periphery of the soundproof unit and the inside surface of the main body of the ventilator, and the air layers of the soundproof unit are communicated with the inner ventilation passage and the space.

According to a further aspect of the present invention, in the ventilator, the widths of a plurality of air layers are changed at substantially a fixed rate.

According to a further aspect of the present invention, in the ventilator, the air layers are partitioned into a great number of spaces by partition plates.

According to a further aspect of the present invention, in the ventilator, the spaces formed by partition plates are positioned substantially radially from the inner ventilation passage toward the outside.

According to a further aspect of the present invention, in the ventilator, at least a part of the soundproof unit is formed from a sound absorbing member.

According to a further aspect of the present invention, in the ventilator, at least a part of the laminated plates are formed from a sound absorbing member.

With the above-described construction of the present invention, the inner ventilation passage whose ventilation area is larger than the fan intake opening is provided in the soundproof unit disposed in a space between the intake opening of the main body of the ventilating fan and the fan intake opening. Air taken in from the fan intake opening by the air blower can pass through the inner ventilation passage. Therefore, ventilation resistance is quite small. In addition, noise generated by the air blower is emitted in all directions from the fan intake opening. Most of the noise enters the air layers formed by laminated plates, and the noise is reduced within the air layers.

Since the outer ventilation passage on the outer periphery of the soundproof unit communicates with the inner ventilation passage via the air layers, air taken in from the fan intake opening by the air blower is guided into the inner ventilation passage from the outer ventilation passage through the air layers. Therefore, the ventilation resistance can be reduced even more.

Since the air layers whose plurality of widths are changed at a fixed rate are formed, noise generated by the air blower of not only a specific frequency, but also of a plurality of frequencies, can be reduced.

Since the air layers are partitioned into a great number of space portions by partition plates and noise which enters the space portions is reflected and absorbed repeatedly, the noise attenuation effect can be increased.

Since the air layers formed by partition plates are positioned substantially radially from the inner ventilation passage toward the outside, noise generated by the air blower, which is emitted in all directions from the fan intake opening, can be efficiently guided into the space portions.

In addition, the soundproof unit, at least a part of which is formed from a sound absorbing member, effectively reduces the noise which enters the air layers.

In addition, the laminated plates, at least a part of which is formed from a sound absorbing member, prevents the noise which enters the air layers from leaking into a room and effectively reduces the noise.

The above and further objects and novel features of the invention will more fully appear from the following detailed description when the same is read in connection with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment of the present invention will be explained below with reference to FIG. 1.

Figure 1:
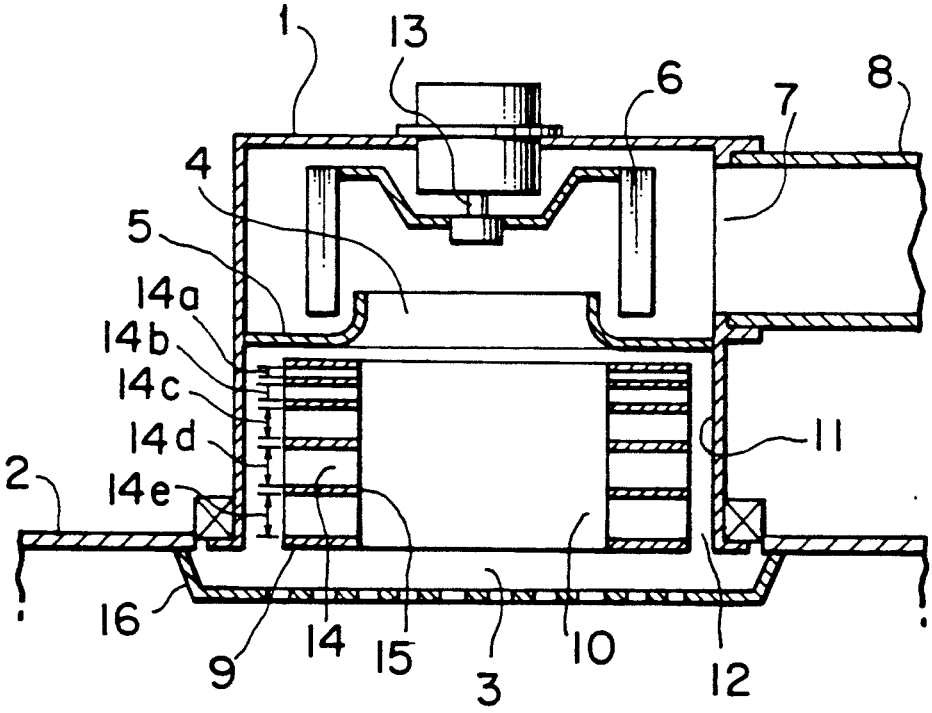
FIG. 1 is a sectional view illustrating a state in which a ventilator is mounted according to one embodiment of the present invention.

As shown in FIG. 1, an air blower 6 having a ventilation casing 5 provided with a fan intake opening 4 facing an intake opening 3 of a main body of a ventilating fan, which intake opening 3 is open to a living room below, is incorporated into the main body 1 disposed on a ceiling surface 2. A discharge opening 7 is formed on a side of the main body 1, which opening 7 communicates with the outside through a duct 8. A soundproof unit 9 formed of laminated plates 15 formed of a plurality of air layers 14 having widths 14*a*, 14*b*, 14*c*, 14*d*, and 14*e* arranged in a direction intersecting the rotation shaft 13 of the air blower 6 from the inner ventilation passage 10, which widths change at a fixed rate, is disposed in a space between the fan intake opening 4 inside the main body 1 and the intake opening 3 of the main body 1. The soundproof unit 9 has an inner ventilation passage 10 having a ventilation area larger than the fan intake opening 4. The soundproof unit 9 is disposed in such a way that a space is formed between the outer periphery thereof and an inner surface 11 of the main body 1. This space communicates with the inner ventilation passage 10 via air layers 14 and forms an outer ventilation passage 12. Reference numeral 16 denotes a decorated grille.

With the above-described construction, noise generated by the air blower 6 is emitted from the fan intake opening 4 in all directions. Most of the noise enters the air layers 14 and is reduced. At the same time, since the air inside the room taken in from the fan intake opening 4 by the air blower 6 passes through the inner ventilation passage 10, having a ventilation area larger than the fan intake opening 4 provided on the soundproof unit 9, ventilation resistance is quite small.

Since the air taken in from this from intake opening 4 is guided from the outer ventilation passage 12 through the air layers 14 to the inner ventilation passage 10, the ventilation resistance becomes even smaller.

Since the widths 14*a*, 14*b*, 14*c*, 14*d* and 14*e* of the air layers 14 change at a fixed rate, noise which enters the air layers 14 at a plurality of frequencies is attenuated by an air layer of a width which corresponds to a frequency with a high reduction effect. Thus, a large reduction effect is exhibited as a whole.

As described above, according to this embodiment, since the ventilation resistance is quite small even if noise generated by the air blower 6 is reduced by the soundproof unit, a decrease in the ventilation efficiency can be prevented. Therefore, a large noise reduction effect can be obtained.

Figure 2:
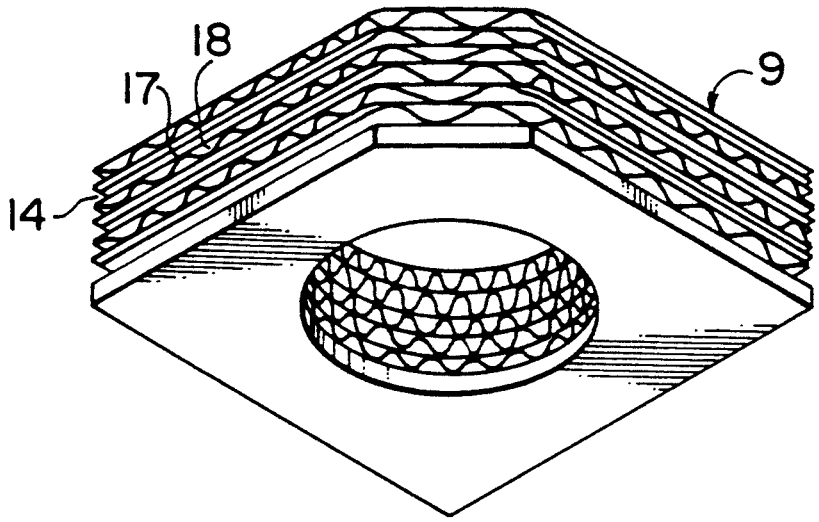
FIG. 2 is a perspective view of a soundproof unit according to another embodiment of the present invention.

Next, another embodiment of the present invention will be explained with reference to FIG. 2.

Components in this embodiment which are the same as in the preceding embodiment are given the same reference numerals, and an explanation thereof is omitted.

A feature of this embodiment is that a single air layer 14 is partitioned into an even greater number of spaces by wave-shaped partition plates 17.

With this construction, noise generated by the air blower 6 is emitted in all directions from the fan intake opening 4. Most of the noise enters a great number of space portions 18, and the noise is reduced inside the space portions 18. Since the space portions 18 are divided into smaller ones by the partition plates 17, the noise reduction effect is high because the noise which enters the space portions 18 is vigorously reflected and absorbed repeatedly.

As described above, according to the another embodiment of the present invention, the ventilating fan has a soundproof unit with a higher soundproofing effect.

Next, a further embodiment of the present invention will be explained with reference to FIG. 3.

Components of this embodiment which are the same as in the preceding and another embodiments are given the same reference numerals, and an explanation thereof is omitted.

Figure 3:
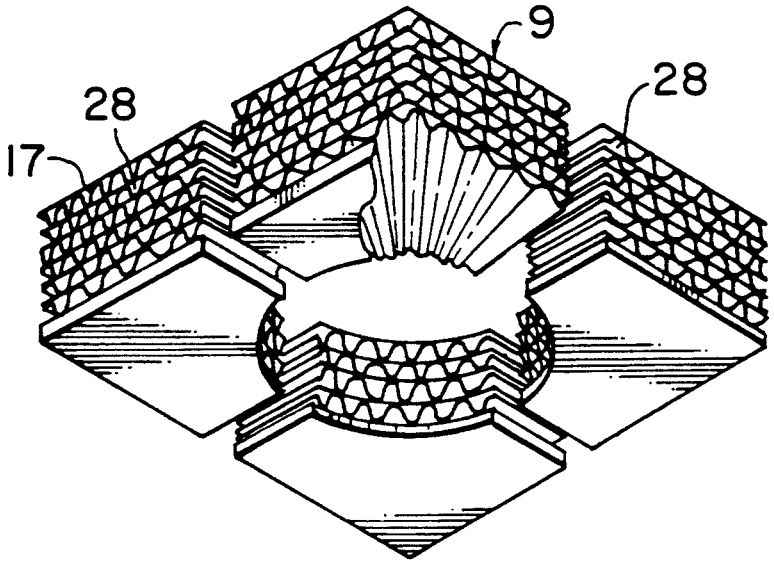
FIG. 3 is a perspective view of the soundproof unit according to a further embodiment of the present invention.

As shown in FIG. 3, this embodiment has a unique feature compared with each of the above-described embodiments in that space portions 28 partitioned by partition plates 17 are arranged substantially radially from the inner ventilation passage 10 toward the outside.

With this construction, noise generated by the air blower 6 is emitted in all directions from the fan intake opening 4, and most of the noise enters the space portions 28 and is reduced. Since the space portions 28 are arranged substantially radially from the inner ventilation passage 10 toward the outside, most of the inner surfaces of the space portions 28 are substantially equally open for the noise flow emitted from the fan intake opening 4. As a result, the generated noise efficiently enters space portions 28, increasing the noise reduction effect.

As described above, according to the ventilating fan of the further embodiment of the present invention, the noise reduction effect of the soundproof unit 9 can be increased without making the size thereof larger.

Although in the another and further embodiments the partition plates 17 are shaped in the form of waves, even if they are formed into other shapes, the operation and effect on the operation thereof is the same if the air layers 14 are partitioned into a great number of space portions.

Next, a yet further embodiment of the present invention will be explained with reference to FIG. 4.

Components in this embodiment which are the same as in the first embodiment are given the same reference numerals, and an explanation thereof is omitted.

Figure 4:
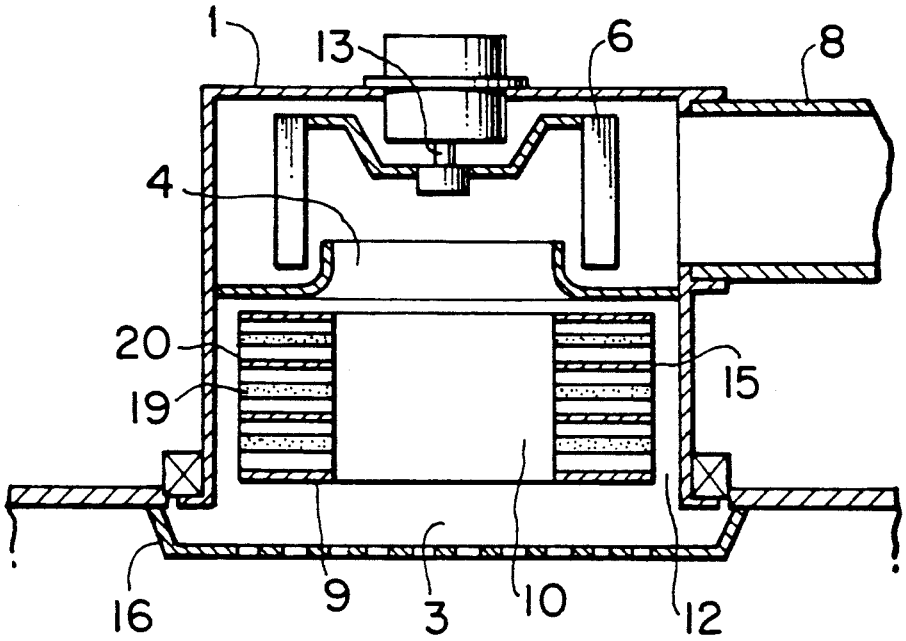
FIG. 4 is a sectional view illustrating a state in which a ventilator is mounted according to a further embodiment of the present invention.
Figure 5:
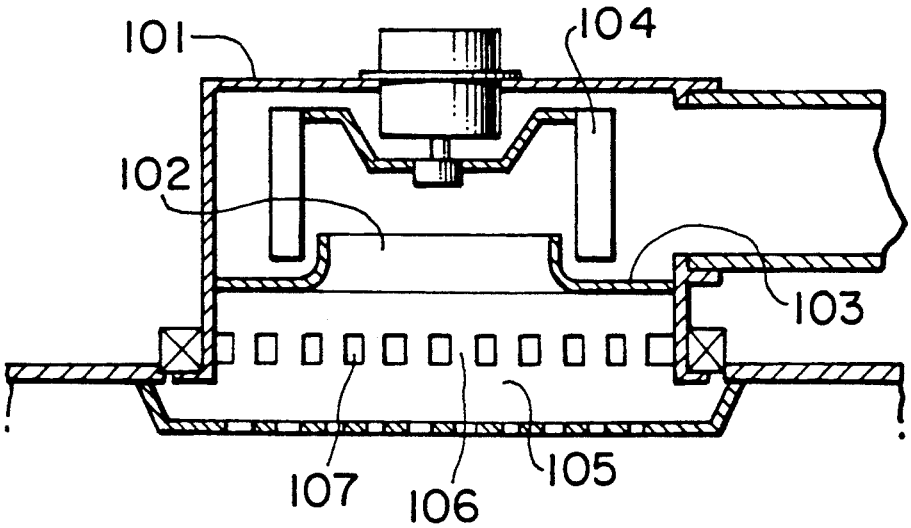
FIG. 5 PRIOR ART
FIG. 5 is a sectional view illustrating a state in which a conventional ventilator is mounted.

As shown in FIG. 4, a part of the laminated plate 15, the component which forms the soundproof unit 9, is formed from a sound absorbing member 19, and another part of the laminated plate 15 is formed from a sound shielding member 20.

With this construction, noise generated by the air blower 6, which enters the air layers 14, is absorbed by the sound absorbing member 19, thus increasing the soundproof effect of the soundproof unit 9.

In a similar manner, since noise generated by the air blower 6, which enters the air layers 14, is shielded by the sound shielding member 20, the noise propagated inside the room can be attenuated even more.

As described above, according to the ventilator of the fourth embodiment, the soundproof effect of the soundproof unit 9 can be increased further without making the volumetric size thereof larger.

Although the sound absorbing member 19 and sound shielding member 20 are laminated alternately in the above-described embodiments, there is some difference, although only a little, in the basic effect on the operation in increasing the soundproof effect of the soundproof unit 9 if all the components of the soundproof unit 9 are formed from sound absorbing members, or if the laminated plate 15 is all formed from a sound shielding member.

Although a ceiling-recessed ventilator is used in the above-described embodiments, needless to say, the same effect can be obtained if the present invention is applied to a ventilator disposed in an opening on a vertical wall.

As is clear from the above-described embodiments, according to the present invention, a ventilator can be provided which prevents an increase in ventilation resistance without deteriorating the sound reduction effect of the soundproof unit, has high ventilation efficiency and can be operated at a low noise level even if a soundproof unit for reducing noise generated by an air blower is disposed in the space between the fan intake opening and an intake opening of the main body of the ventilating fan.

In addition, ventilation efficiency can be increased even further as a result of preventing an increase in ventilation resistance caused by the provision of the soundproof unit, without deteriorating the sound reduction effect of the soundproof unit. It is also possible to increase the effect of the soundproof unit to insulate noise generated by an air blower by making it easy to reduce noise of a plurality of frequencies without making the size thereof larger. Since air layers by which noise is attenuated are partitioned into a great number of space portions, the noise is attenuated even more and the soundproof effect can be increased, also, without making the volumetric size thereof larger.

The soundproof effect of the soundproof unit can be increased by efficiently guiding noise generated by the air blower, which noise is emitted in all directions from the fan intake opening, also, without making the size thereof larger.

Since sound absorbing members are used for components of the soundproof unit, such as laminated plates formed of air layers having a sound reduction effect, the sound reduction effect is increased further, also, without making the size thereof larger.

Since sound shielding members are used for laminated plates formed of air layers having a sound reduction effect, a soundproof unit having a high soundproof effect can be formed by preventing noise entering the air layers from entering the room, also, without making the size thereof larger.

Many different embodiments of the present invention may be constructed without departing from the spirit and scope of the present invention. It should be understood that the present invention is not limited to the specific embodiments decreased in this specification. Further, the present invention is intended to cover various modifications and equivalent arrangements included with the spirit and scope of the claims. The following claims are to be accorded a broad interpretation, so as to encompass all such modifications and equivalent structures and functions.

What is claimed is:

1. A ventilator, comprising:

a main body which includes an intake opening;

an air blower, incorporated in the main body, having a ventilation casing provided with a fan intake opening facing the intake opening of the main body; and a cylindrical soundproof unit including an inner ventilation passage having a ventilation area which is larger than a fan intake space defined by the fan intake opening and which comprises a laminated plate which defines a plurality of air layers arranged in a direction intersecting a rotation axis of the air blower from the inner ventilation passage, said cylindrical soundproof unit being disposed between the fan intake opening and the intake opening of the main body, the soundproof unit being disposed so as to define a space between an outer periphery of the soundproof unit and an inner surface of the main body, and the plurality of air layers defined by said laminated plate of said soundproof unit being in communication with the inner ventilation passage and with the space.

2. A ventilator according to claim 1, wherein widths of at least some of the plurality of air layers are changed at a substantially fixed rate.

3. A ventilator according to claim 2, further comprising partition plate means for partitioning the air layers into a plurality of space portions.

4. A ventilator according to claim 3, wherein the space portions formed by the partition plate means extend substantially radially from the inner ventilation passage toward the outer periphery of the soundproof unit.

5. A ventilator according to claim 1, wherein at least a part of the soundproof unit is formed from a sound absorbing member.

6. A ventilator according to claim 1, wherein at least a part of the laminated plate is formed from a sound shielding member.

* * * * *